US010775715B2

(12) United States Patent
Sabo et al.

(10) Patent No.: US 10,775,715 B2
(45) Date of Patent: Sep. 15, 2020

(54) ROLLER SEAL FOR A DEVELOPER UNIT IN A LIQUID ELECTROPHOTOGRAPHIC PRINTER

(71) Applicant: HP Indigo B.V., Amstelveen (NL)

(72) Inventors: David Sabo, San Diego, CA (US); John Godden, San Diego, CA (US); Stanley Kozmiski, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/461,118

(22) PCT Filed: Jan. 31, 2017

(86) PCT No.: PCT/EP2017/052072
§ 371 (c)(1),
(2) Date: May 15, 2019

(87) PCT Pub. No.: WO2018/141369
PCT Pub. Date: Aug. 9, 2018

(65) Prior Publication Data
US 2020/0064755 A1 Feb. 27, 2020

(51) Int. Cl.
*G03G 15/08* (2006.01)
*G03G 15/11* (2006.01)
*G03G 21/00* (2006.01)

(52) U.S. Cl.
CPC ..... *G03G 15/0817* (2013.01); *G03G 15/11* (2013.01); *G03G 21/0058* (2013.01)

(58) Field of Classification Search
CPC ..... G03G 15/0817
See application file for complete search history.

(56) References Cited

U.S. PATENT DOCUMENTS

| | | | | |
|---|---|---|---|---|
| 5,655,178 | A | 8/1997 | Ishikawa et al. | |
| 6,094,550 | A | 7/2000 | Kido et al. | |
| 6,487,383 | B2 | 11/2002 | Buchanan et al. | |
| 6,512,902 | B2 | 1/2003 | Kasiske et al. | |
| 6,597,880 | B2 | 7/2003 | Park | |
| 8,855,527 | B2 | 10/2014 | Pingel et al. | |
| 9,250,572 | B2 | 2/2016 | Karp et al. | |
| 2008/0112723 | A1* | 5/2008 | Oguma | G03G 15/0817 399/104 |
| 2013/0223888 | A1 | 8/2013 | Tanner et al. | |
| 2014/0029971 | A1 | 1/2014 | Pingel et al. | |
| 2016/0349668 | A1* | 12/2016 | Pingel | G03G 15/0812 |

FOREIGN PATENT DOCUMENTS

WO WO-2015116206 A2 8/2015

* cited by examiner

*Primary Examiner* — Walter L Lindsay, Jr.
*Assistant Examiner* — Milton Gonzalez
(74) *Attorney, Agent, or Firm* — Steven R. Ormiston

(57) ABSTRACT

In one example, a seal for a developer roller in a liquid electrophotographic printer includes an arcuate body curved along a body arc. The body has an inboard face that defines an annular sealing surface along the body arc to contact a face on one end of the developer roller and a guide surface across the body arc at a first end of the annular sealing surface. The guide surface is oriented along a chord of the body arc and intersects the body arc at an obtuse interior angle, to guide any ink encountering the guide surface outward toward the circular outer surface of the developer roller.

14 Claims, 7 Drawing Sheets

ROLLER SEAL FOR A DEVELOPER UNIT IN A LIQUID ELECTROPHOTOGRAPHIC PRINTER

BACKGROUND

Liquid electrophotographic (LEP) printing uses a special kind of ink to form images on paper and other print substrates. LEP ink usually includes charged polymer particles dispersed in a carrier liquid. The polymer particles are sometimes referred to as toner particles and, accordingly, LEP ink is sometimes called liquid toner. LEP ink may also include a charge control agent to help control the magnitude and polarity of charge on the particles. An LEP printing process involves placing an electrostatic pattern of the desired printed image on a photoconductor and developing the image by presenting a thin layer of LEP ink to the charged photoconductor. The ink may be presented to the photoconductor with a roller that is commonly referred to as a "developer roller." Charged toner particles in the ink adhere to the pattern of the desired image on the photoconductor. The ink image is transferred from the photoconductor to a print substrate, for example through a heated intermediate transfer member that evaporates much of the carrier liquid to dry the ink film, and then to the print substrate as it passes through a nip between the intermediate transfer member and a pressure roller

DRAWINGS

The same part numbers designate the same or similar parts throughout the figures. The figures are not necessarily to scale.

DESCRIPTION

In liquid electrophotographic printing, a thin film of LEP ink is applied to the exterior of a developer roller and then presented to a photoconductor at a nip between the developer roller and the photoconductor. A squeegee roller rotates against the developer roller to squeegee excess carrier liquid from the ink film before the ink is presented to the photoconductor. A cleaner roller rotates against the developer roller to remove residual ink after ink has been transferred to the photoconductor. The ends of each roller are sealed to help prevent ink leaking away from the rollers.

A new sealing system has been developed for the developer, squeegee, and cleaner rollers in an LEP developer unit to help contain ink at the ends of the rollers. In one example, the sealing system includes a first pair of face seals to seal the ends of the squeegee roller and the cleaner roller and a second pair of face seals to seal the ends of the developer roller. Each of the face seals for the developer roller is located inboard from the corresponding face seal for the squeegee and cleaner rollers and includes an annular sealing surface to contact the end face of the developer roller. Each of the seals for the developer roller also includes a guide surface intersecting the sealing surface near the nip between the developer roller and the cleaner roller. This guide surface helps guide any ink that does leak past the seal toward the cleaner roller where it can be removed along with ink cleaned from the surface of the developer roller. Each of the seals for the developer roller may also include radial sealing surfaces that partially surround the outboard ends of the squeegee roller and the cleaner roller.

These and other examples shown in the figures and described below illustrate but do not limit the scope of the patent, which is defined in the Claims following this Description.

As used in this document, "annular" means fully ring shaped like an annulus, or partially ring shaped like an annulus sector.

Figure 1:
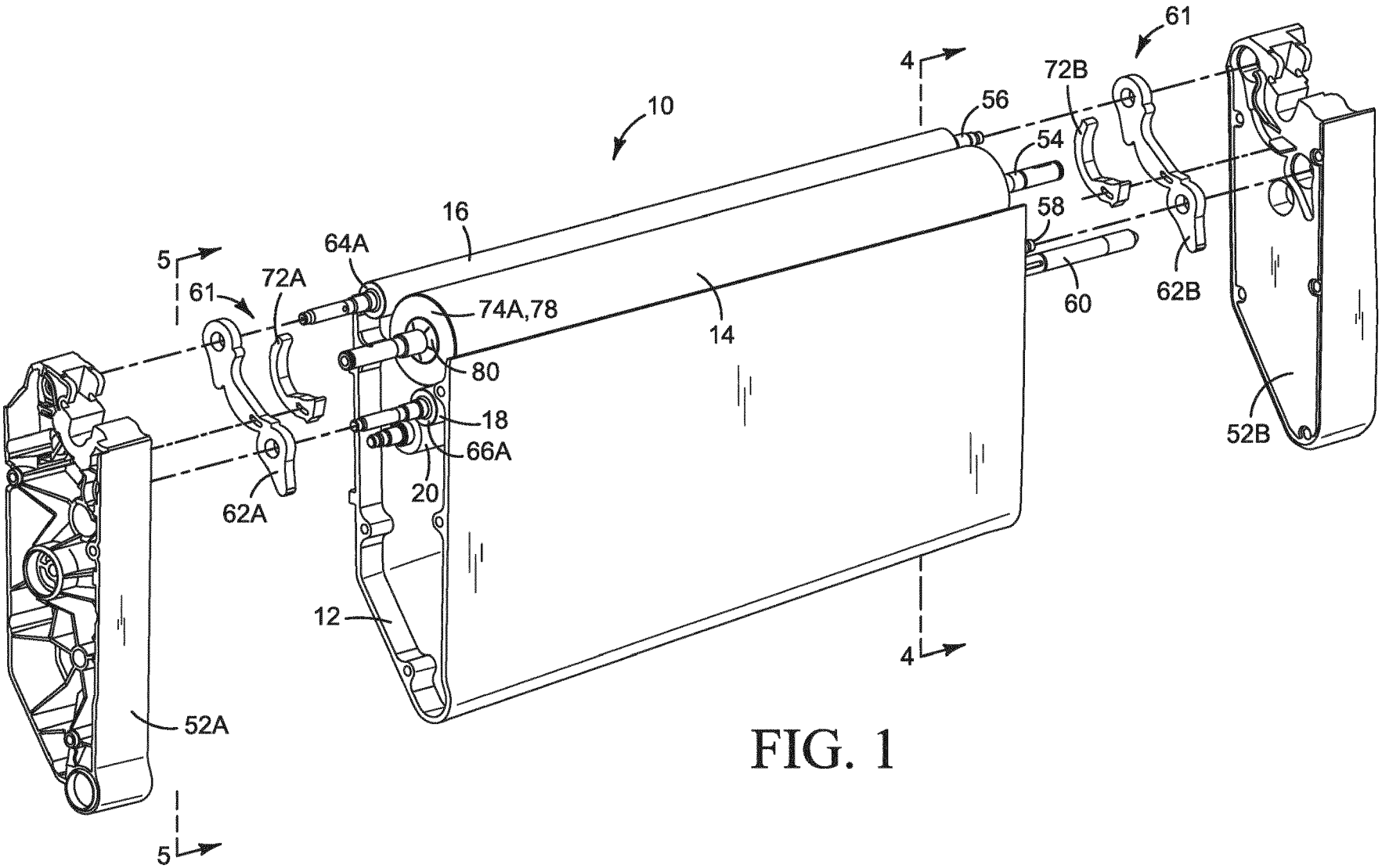
FIG. 1 is an isometric, partially exploded view illustrating one example of a developer unit for liquid electrophotographic printing.
Figure 2:
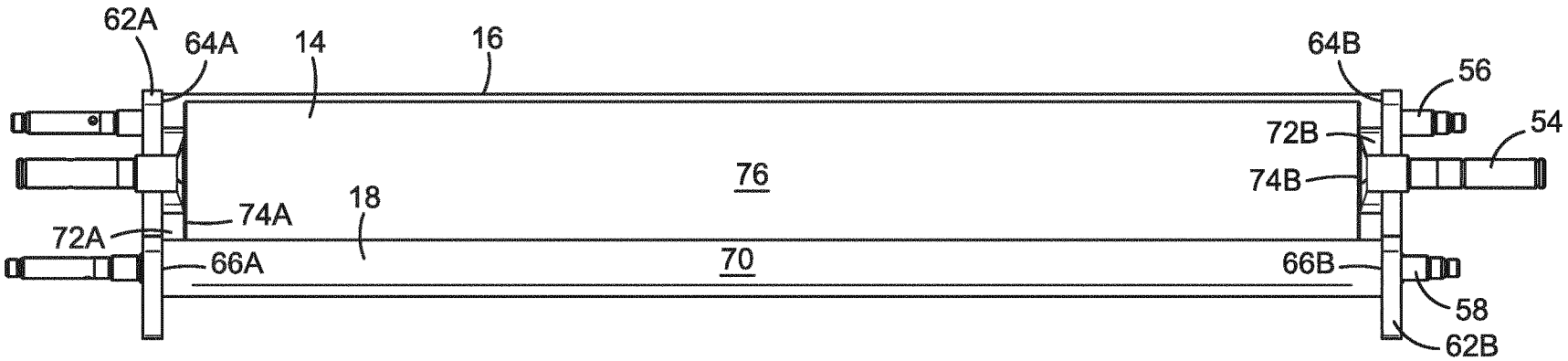
FIGS. 2 and 3 are elevation and isometric views, respectively, showing rollers and seals from the developer unit in FIG. 1.
Figure 3:
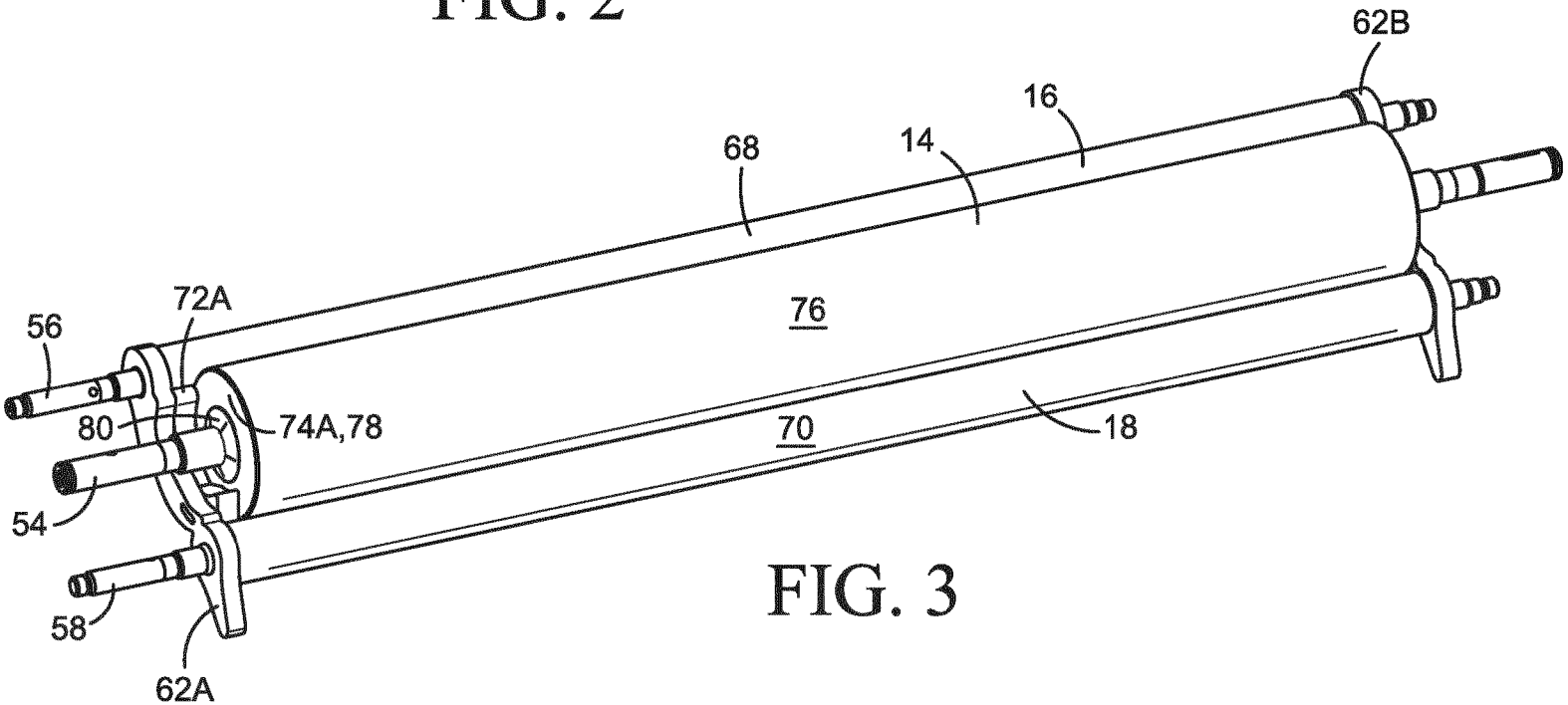
Figure 4:
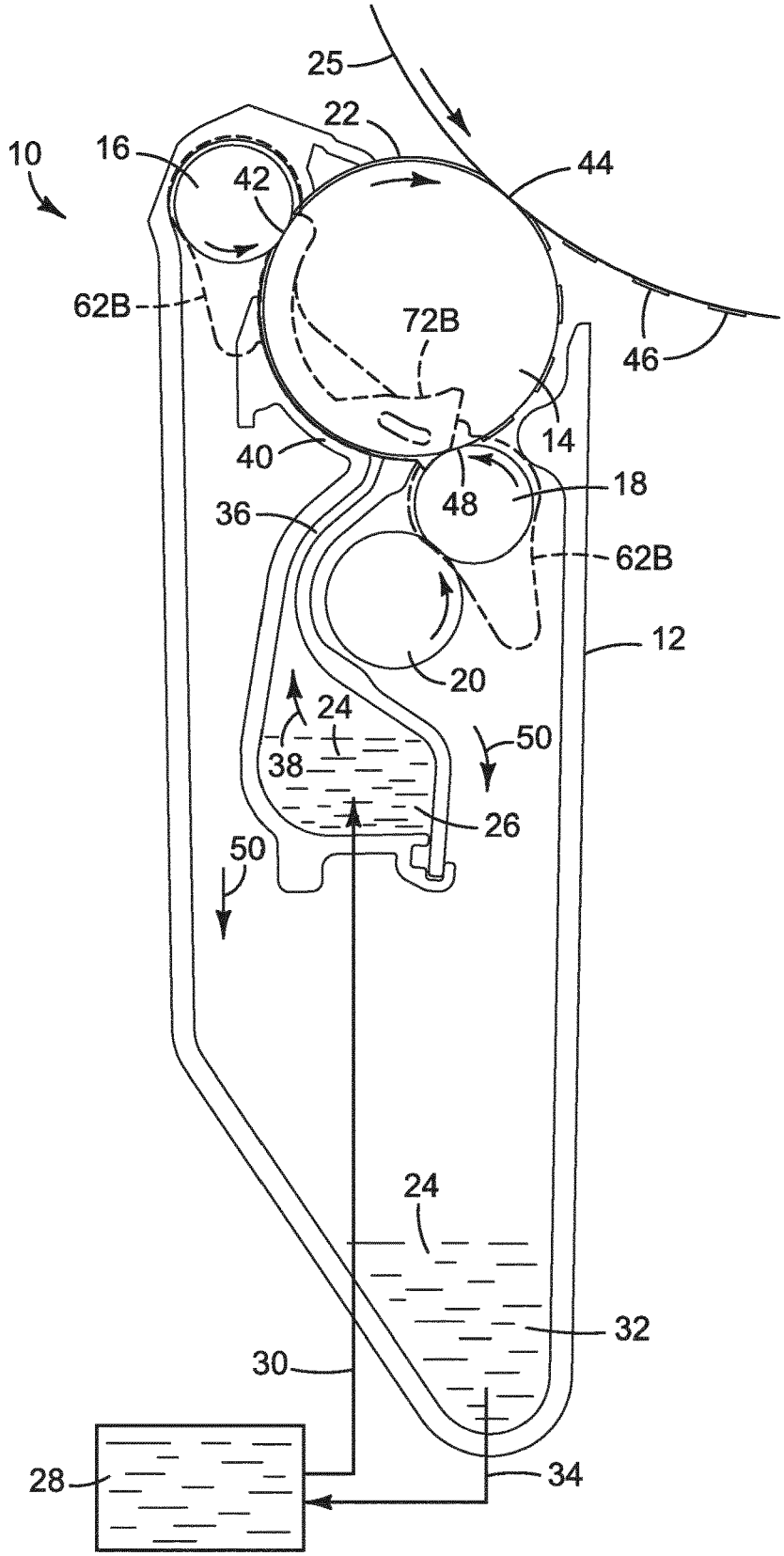
FIG. 4 illustrates one example of a section along the line 4-4 in FIG. 1.
Figure 5:
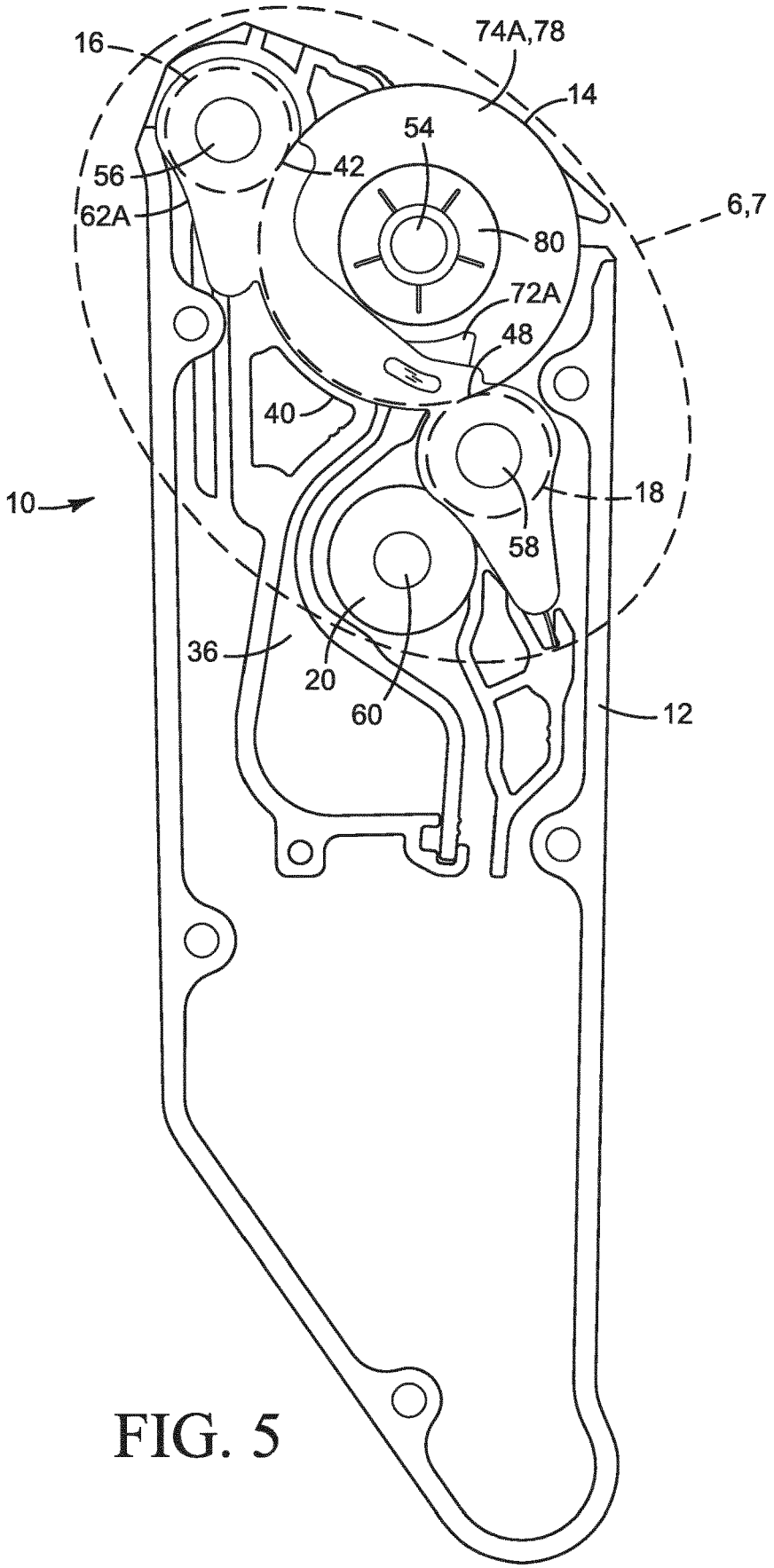
FIG. 5 illustrates one example of a section along the line 5-5 in FIG. 1.

FIG. 1 is an isometric, partially exploded view illustrating one example of a developer unit 10 for a liquid electrophotographic printer. FIGS. 2 and 3 are elevation and isometric views, respectively, showing rollers and seals from developer unit 10 in FIG. 1. FIG. 4 illustrates one example of a section along line 4-4 in FIG. 1. Hatching is omitted and some of the parts are simplified in FIG. 4 for clarity. FIG. 5 illustrates one example of a section along line 5-5 in FIG. 1. A developer unit for an LEP printer is commonly referred to as a "binary ink developer" or a "BID." An LEP printer may include multiple BIDs, one for each color ink for example.

Referring to FIGS. 1-5, developer unit 10 includes a housing 12 housing a developer roller 14, a squeegee roller 16, a cleaner roller 18, and a sponge roller 20. Referring specifically to FIG. 4, developer roller 14 is exposed outside housing 12 to present a film 22 of LEP ink 24 to a photoconductor 25. LEP ink 24 may be pumped to a local supply chamber 26 in developer unit 10 from an external reservoir 28 through an inlet 30, as shown diagrammatically in FIG. 4. Also, excess ink 24 may be reclaimed and collected in a local return chamber 32 and returned to reservoir 28 through an outlet 34. In operation, according to one example, supply chamber 26 is pressurized to force ink 24 up through a channel 36 to the electrically charged developer roller 14, as indicated by flow arrow 38. A thin layer of ink is applied electrically to the surface of a rotating developer roller 14 along an electrode 40. A voltage difference between developer roller 14 and electrode 40 causes charged particles in the LEP ink to adhere to roller 14. Squeegee roller 16 rotates along developer roller 14 to squeegee excess carrier liquid from the ink on roller 14 while charged particles in the ink continue to adhere developer roller 14. In the example shown, developer roller 14 is rotated clockwise and squeegee roller 16 is rotated counterclockwise so that the surfaces move in the same direction at the nip 42 between rollers 14 and 16

The now more concentrated ink film 22 on developer roller 14 is presented to photoconductor 25 where some of the ink is transferred in the pattern of a latent electrostatic image on the photoconductor at the nip 44 between roller 14 and photoconductor 25, as the desired ink image 46. A charged cleaner roller 18 rotates along developer roller 14 to electrically remove residual ink from roller 14. In the example shown, cleaner roller 18 is rotated counterclockwise so that the surfaces move in the same direction at the nip 48 between rollers 14 and 18. In this example, cleaner roller 18 is scrubbed with a so-called "sponge" roller 20 that is rotated against cleaner roller 18. In the example shown, sponge roller 20 is rotated counterclockwise so that the surfaces move in opposite directions at the nip between rollers 18 and 20. Some of the ink residue may be absorbed into sponge roller 20 and some may fall away. Excess carrier liquid and ink drains to return chamber 32, as indicated by flow arrows 50, where it can be recycled to reservoir 28.

Referring again to FIGS. 1-5, developer unit 10 also includes end caps 52A, 52B attached to housing 12 to support each roller 14-20 on its respective shaft 54-60. A roller sealing system 61 includes a pair of first face seals 62A, 62B between end caps 52A, 52B and the ends 64A, 64B of squeegee roller 16 and the ends 66A, 66B of cleaner roller 18, to help prevent ink from leaking off the circular outer surfaces 68, 70 past the ends of rollers 16, 18. Sealing system 61 also includes a pair of second face seals 72A, 72B between end caps 52A, 52B and the ends 74A, 74B of developer roller 14, to help prevent ink from leaking off the circular outer surface 76 past the ends of roller 14. In this example, as best seen in FIGS. 2 and 3, developer roller 14 is shorter than squeegee roller 16 and cleaner roller 14, and each developer roller face seal 72A, 72B is located inboard from each squeegee/cleaner roller face seal 62A, 62B.

In this example, developer roller 14 includes an anti-friction ring 78 at each end 74A, 74B to reduce friction between roller 14 and face seals 72A, 72B. Anti-friction rings 78 may be desirable, for example, where friction between the ends of developer roller 14 and face seals 72A, 72B creates an unacceptable risk of damaging the seals without anti-friction rings. Each ring 78 is constructed as a thin flat disk made of polytetrafluoroethylene (PTFE) or another suitably low friction material. The outer diameter of rings 78 may be slightly smaller than the diameter of outer surface 76 so that the rings do not interfere with roller nips 42 and 48. Low friction rings 78 may be secured in place, for example, with push-on retainers 80 on shaft 54. Push-on retainers 80 may be desirable, for example, to secure rings 78 pre-flexed with a concave shape (bowed out at the center of the ring) to help keep the rings flat when installed. A push-on retainer takes advantage of the outboard force at the center of the ring for a more secure fit.

Figure 6:
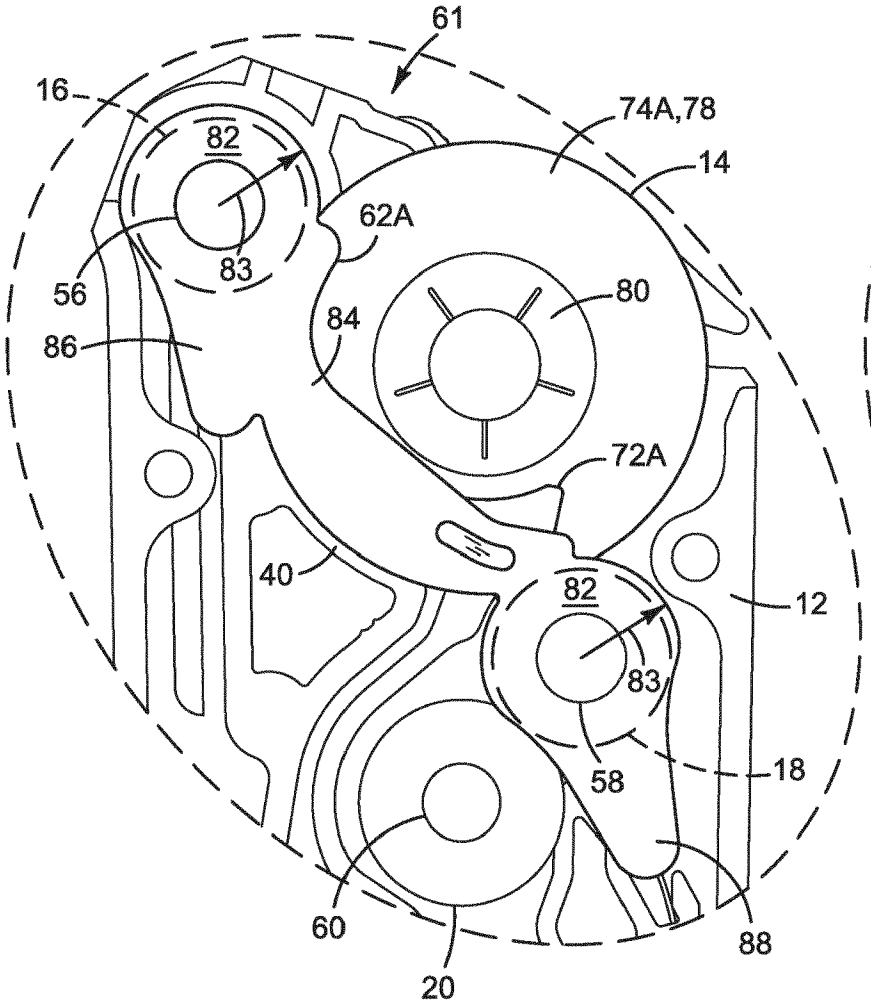
Figure 10:
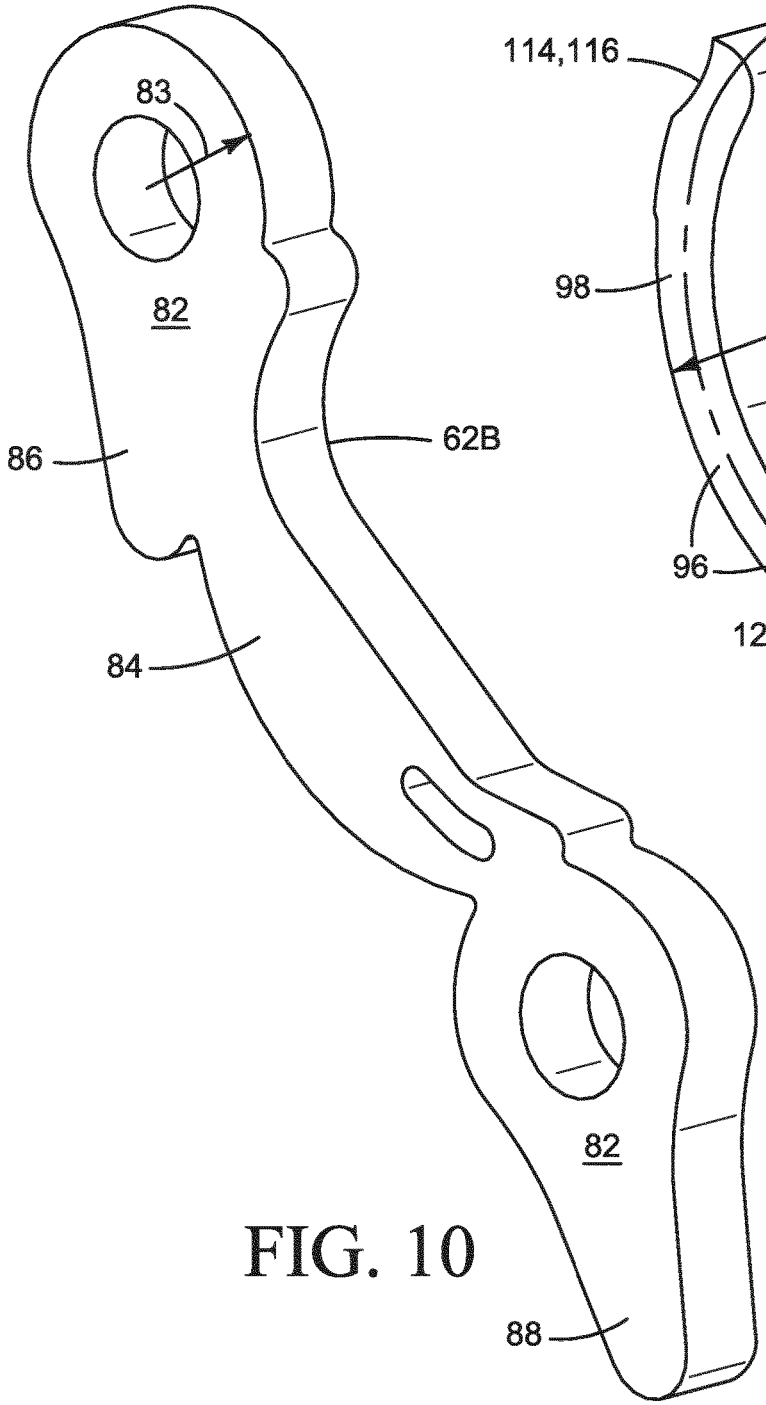
FIG. 10 is an isometric detail of the outboard seal shown in FIG. 9.

Referring to the detail views of FIGS. 6 and 10, each outboard seal 62A, 62B is constructed as a single part to seal the ends of both the squeegee roller 16 and the cleaner roller 18. Also in this example, each seal 62A, 62B encircles shafts 56, 58 with a continuous face 82 to seal around the full circumference of roller ends 64A, 64B and 66A, 66B. In one example, the radius 83 of each face 82 is greater than the diameter of the corresponding roller 16, 18 to block ink from leaking outboard over the edge of the seal. The generally circular sealing faces 82 are joined by a web 84. Each seal 62A, 62B may also include lobes 86 and 88, for example to help seal a splash guard 90 and a doctor blade 92, respectively. Splash guard 90 and doctor blade 92 are called out in FIG. 7.

Figure 7:
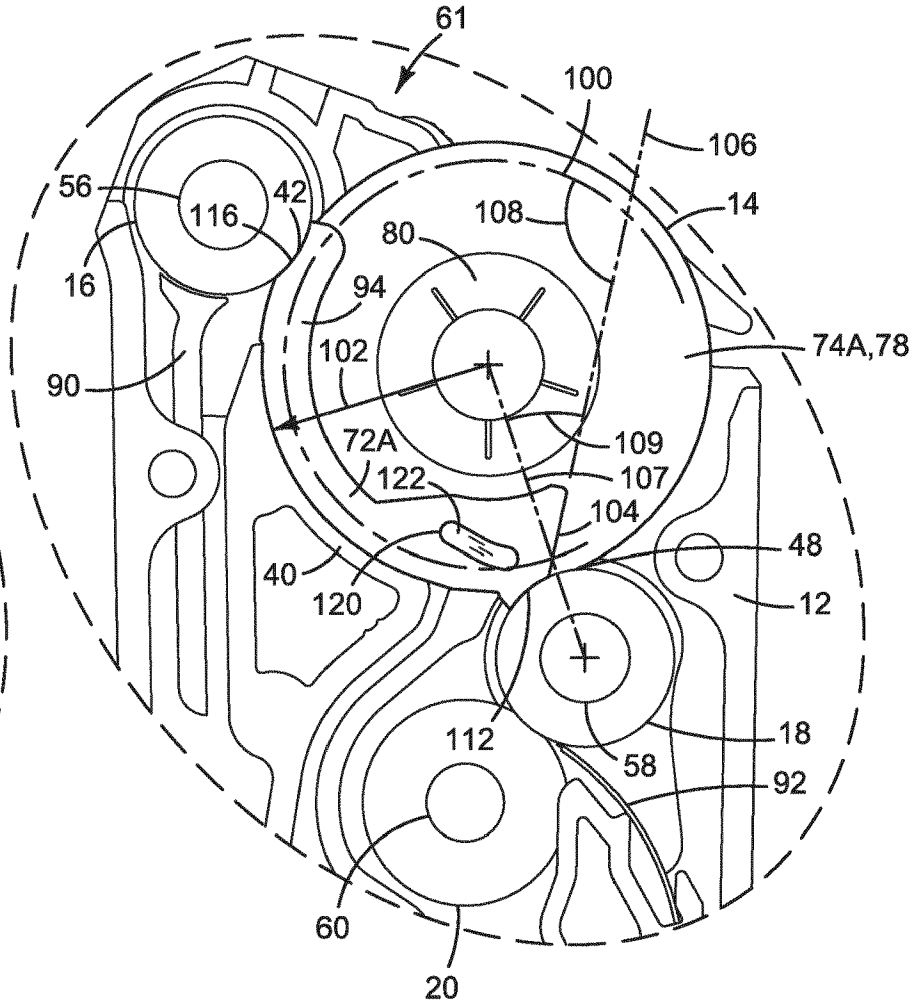
FIGS. 6 and 7 are details from FIG. 5. The outboard seal is omitted in FIG. 7 to more clearly show the inboard seal.

Outboard, squeegee and cleaner roller face seal 62A is omitted in FIG. 7 to more clearly show inboard, developer roller face seal 72A. Referring to the detail views of FIGS. 7 and 11, in this example each seal 72A, 72B is constructed as an arcuate body 94 that includes an inboard face 96 defining an annular sealing surface 98 along the arc 100 of body 94, to contact the end face 74A, 74B of roller 14 (FIGS. 2 and 3). Although it is expected that body arc 100 usually will be a circle, corresponding to a circular roller 14, other suitable curves are possible. As noted above, in the example shown in the figures, the face on each end 74A, 74B of roller 14 is formed by an anti-friction ring 78. In other examples, there are no anti-friction rings on the ends of developer roller 14. In one example, the outer radius 102 of sealing surface 98 is greater than the outer radius of the end of the developer roller 14, to help block ink from leaking outboard over the edge of the seal.

Figure 11:
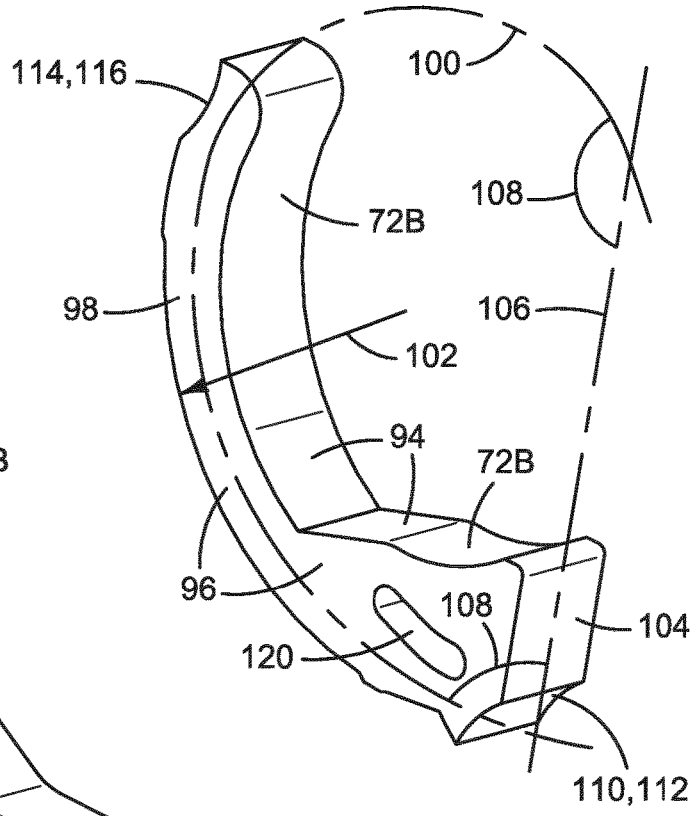
FIG. 11 is an isometric detail of the inboard seal shown in FIG. 9.

Seal body 94 also includes a guide surface 104 to help guide any ink that does leak past face 96 toward cleaner roller 18 where it can be removed along with ink residue cleaned from the surface of developer roller 14. Guide surface 104 is oriented across body arc 100 at one end of annular sealing surface 98 near nip 48 between rollers 14 and 18. Guide surface 104 is oriented along a chord 106 of body arc 100 that intersects body arc 100 at an obtuse interior angle 108. As shown in FIG. 7, guide surface 104 intersects a line 107 between the center points (axes of rotation) of developer roller 14 and cleaner roller 18 at an acute angle 109 greater than 0°. Also in this example, as best seen in FIG. 11, guide surface 104 intersects annular sealing surface 98 at a right angle. While the length of guide surface 104 along chord 106 may vary, guide surface 104 should extend inward (toward the interior of body arc 100) further than any other part of seal body 94. With this configuration, any ink encountering guide surface 104 is guided outward toward the circular outer surface of developer roller 14 and on to cleaner roller 18. Testing shows that a guide surface 104 significantly reduces the accumulation of ink at the ends of the developer roller compared to a face seal 72A, 72B that does not include a guide surface 104.

Developer roller seal body 94 may also include a sealing surface 110 at the end of annular sealing surface 98 near nip 48. Sealing surface 110 conforms to the shape of the outer surface 70 (FIG. 3) of cleaner roller 18. As best seen in FIG. 7, surface 110 is pressed against roller surface 70 to form a radial seal 112 near each end of cleaner roller 18. Seal body 94 may also include a sealing surface 114 at the end of annular sealing surface 98 near nip 42. Sealing surface 114 conforms to the shape of the outer surface 68 (FIG. 3) of squeegee roller 16. As best seen in FIG. 7, surface 114 is pressed against roller surface 68 to form a radial seal 116 near each end of squeegee roller 16.

Figure 8:
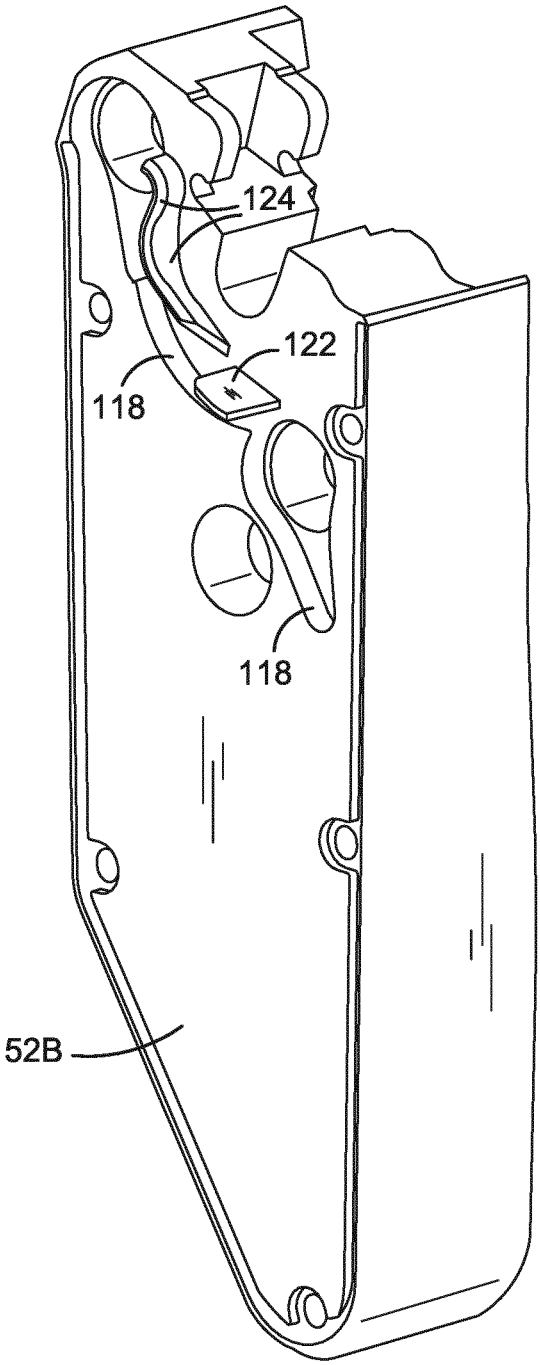
FIGS. 8 and 9 are isometric views illustrating the example seals and end cap in the developer unit shown in FIG. 1. The seals are omitted in FIG. 9 to more clearly show the end cap.
Figure 9:
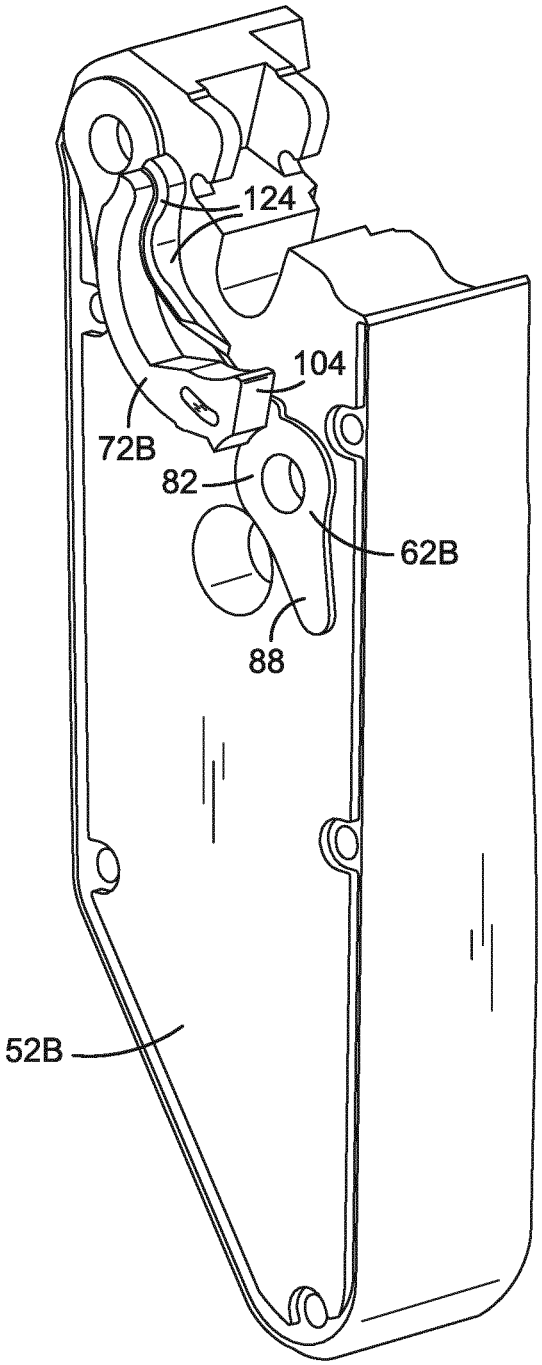

FIGS. 8 and 9 are isometric views illustrating seals 62B, 72B and end cap 52B in developer unit 10 shown in FIG. 1. The seals are omitted in FIG. 8 to more clearly show the end cap. The configuration of seals 62A, 72A and end cap 52A in developer unit 10 in FIG. 1 is the same as that shown in FIGS. 8 and 9 for seals 62B, 72B and end cap 52B. Referring to FIGS. 8 and 9, outboard seal 62B fits into a pocket 118 in end cap 52B to help keep the seal in the desired position against the spinning rollers 16 and 18. Seal 62B may be glued to the end cap for additional stability. A mortise 120 on inboard seal 72B fits over a tenon 122 on end cap 52B to help keep the seal in the desired position against the spinning rollers 14 and 18. In this example, a fixture 124 on endcap 52B is fitted to the inside curvature at the less bulky end of the seal 72B near radial seal 116 for added support to resist the motion of developer roller 14 and squeegee roller 16. Inboard seal 72B may be glued to outboard seal 62B for additional stability.

Seals 62A, 62B and 72A, 72B may be made of a closed cell foam or another suitably resilient material that is compressible between an end cap and a roller. For a replaceable developer roller 14, there can be some variation in the length and position of the roller, and so the sealing system should be able to accommodate a corresponding variation in seal compression. For a closed cell foam, at least 0.5 mm of foam compression is desired to form an effective face seal while the foam tends to take a set when compressed 10% or more. Thus, for an installation in which the position of the ends of the developer roller may vary ±0.5 mm, an overall combined thickness of 10.5 mm to 12.5 mm for the two seals 62A/72A and 62B/72B will help maintain a good seal without taking a set, and while still maintaining acceptable lateral stability. Although shown as separate parts, seals 62A/72A and 62B/72B could be molded or otherwise formed as a single part.

As noted above, the examples shown in the figures and described herein illustrate but do not limit the scope of the patent, which is defined in the following Claims.

"A", "an" and "the" used in the claims means one or more.

The invention claimed is:

1. A seal for a developer roller in a liquid electrophotographic printer, the seal comprising an arcuate body curved along a body arc and including:

an inboard face that defines an annular sealing surface along the body arc to contact a face on one end of the developer roller; and a guide surface across the body arc at a first end of the annular sealing surface, the guide surface oriented along a chord of the body arc and intersecting the body arc at an obtuse interior angle, to guide any ink encountering the guide surface outward toward the circular outer surface of the developer roller.

2. The seal of claim 1, where the guide surface intersects the annular sealing surface at a right angle and the guide surface extends inward further than any other part of the body.

3. The seal of claim 1, where the body includes:

a first surface at the first end of the annular sealing surface to seal against a circular outer surface of a cleaner roller; and a second surface at a second end of the annular sealing surface to seal against a circular outer surface of a squeegee roller.

4. The seal of claim 1, where the body includes a mortise to receive a tenon to keep the annular sealing face rotationally stationary against the end of a rotating developer roller.

5. A sealing system for a developer unit in a liquid electrophotographic printer, comprising:

a pair of first seals each to contact a face on one end of a squeegee roller and a face on one end of a cleaner roller; and a pair of second seals each located inboard from a corresponding first seal to contact a face on one end of a developer roller, each second seal including an inboard face that defines an annular sealing surface to contact one end of the developer roller and a guide surface intersecting the annular sealing surface to guide any ink encountering the guide surface toward the circular outer surface of the cleaner roller.

6. The system of claim 5, where each of the first seals is a single part that includes a continuous first face encircling a first hole to seal around a full circumference of the end of the squeegee roller, a continuous second face encircling a second hole to seal around a full circumference of the end of the cleaner roller, and a web connecting the upper face and the lower face.

7. A developer unit for a liquid electrophotographic printer, comprising:

a developer roller to present LEP ink to a photoconductor, the developer roller rotatable on a shaft;

a squeegee roller to squeegee ink on the developer roller at an upstream nip between the developer roller and the squeegee roller, the squeegee roller rotatable on a shaft;

a cleaner roller to clean ink from the developer roller at a downstream nip between the developer roller and the cleaner roller, the cleaner roller rotatable on a shaft;

an end cap at each end of the rollers to support the rollers on their respective shafts;

resilient first seals each compressed between an end cap and one end of the squeegee roller and one end of the cleaner roller such that an inboard face of each first seal presses against the corresponding end of the squeegee roller and against the corresponding end of the cleaner roller; and resilient second seals each inboard from one of the first seals and compressed between an end cap and one end of the developer roller such that an inboard face of each second seal presses against the corresponding end of the developer roller, each second seal having a guide surface intersecting the inboard face to guide any ink encountering the guide surface toward the cleaner roller.

8. The developer unit of claim 7, where:

the circular outer surface of the squeegee roller is longer than the circular outer surface of the developer roller such that each end of the squeegee roller extends outboard past the corresponding end of the developer roller; and one end of each second seal presses against the circular outer surface of the squeegee roller where it extends past the end of the developer roller.

9. The developer unit of claim 7, where:

the circular outer surface of the of the cleaner roller is longer than the circular outer surface of the developer roller such that each end of the cleaner roller extends outboard past the corresponding end of the developer roller; and one end of each second seal presses against the circular outer surface of the cleaner roller where it extends past the end of the developer roller.

10. The developer unit of claim 7, where:

each second seal comprises an arcuate body having a body arc;

the inboard face defines an annular sealing surface along the body arc to contact a flat face on the end of the developer roller; and the guide surface extends across the body arc at one end of the annular sealing surface, the guide surface oriented along a chord of the body arc and intersecting the body arc at an obtuse interior angle.

11. The developer unit of claim 7, where the guide surface on each second seal intersects a line between a center point of the developer roller and a center point of the cleaner roller at an acute angle greater than 0°.

12. The developer unit of claim 7, where the body of each second seal includes a mortise and the corresponding end cap includes a tenon in the mortise, to keep the annular sealing face rotationally stationary against the end of a rotating developer roller.

13. The developer unit of claim 7, where each end cap includes a pocket containing one of the first seals.

14. The developer unit of claim 7, where each first seal is a single part that extends between the squeegee roller and the cleaner roller.

* * * * *